US006547231B1

(12) United States Patent
Chick

(10) Patent No.: US 6,547,231 B1
(45) Date of Patent: Apr. 15, 2003

(54) APPARATUS FOR PLACING INSERTS OF DIFFERENT THICKNESSES AND WIDTHS INTO NEWSPAPER JACKETS

(75) Inventor: Charles T. Chick, Lee's Summit, MO (US)

(73) Assignee: USA Leader, LLC, Little Rock, AR (US)

( * ) Notice: Subject to any disclaimer, the term of this patent is extended or adjusted under 35 U.S.C. 154(b) by 92 days.

(21) Appl. No.: 09/817,508

(22) Filed: Mar. 27, 2001

Related U.S. Application Data

(60) Provisional application No. 60/196,892, filed on Apr. 13, 2000.

(51) Int. Cl.[7] ..... B65H 39/02

(52) U.S. Cl. ..... 270/58.29; 270/52.19; 270/52.21; 270/58.21; 271/82; 271/225

(58) Field of Search ..... 270/58.18, 58.21, 270/58.22, 58.23, 58.24, 58.26, 58.29, 52.26, 52.29, 52.21, 52.19, 52.2; 271/225, 3.21, 277, 275, 82

(56) References Cited

U.S. PATENT DOCUMENTS

| | | | | | |
|---|---|---|---|---|---|
| 2,173,118 | A | * | 9/1939 | Krueger | 270/52.16 |
| 2,577,261 | A | | 12/1951 | Moser | |
| 3,148,876 | A | * | 9/1964 | Chandler et al. | 271/12 |
| 4,085,927 | A | | 4/1978 | Muller | |
| 4,221,373 | A | | 9/1980 | Muller Hans | |
| 4,401,299 | A | * | 8/1983 | Muller | 270/52.21 |
| 4,402,496 | A | | 9/1983 | Muller | |
| 4,478,399 | A | | 10/1984 | Morin et al. | |
| 4,533,132 | A | | 8/1985 | Wangermann | |
| 4,768,770 | A | * | 9/1988 | Pessina et al. | 270/52.14 |
| 5,082,256 | A | * | 1/1992 | Bryson | 270/52.2 |
| 5,141,216 | A | | 8/1992 | Ballestrazzi et al. | |
| 5,326,088 | A | | 7/1994 | Newsome | |
| 5,613,670 | A | * | 3/1997 | Ballestrazzi et al. | 270/58.29 |
| 6,042,102 | A | * | 3/2000 | Raschke et al. | 271/108 |

* cited by examiner

*Primary Examiner*—Patrick H. Mackey
(74) *Attorney, Agent, or Firm*—Donald A. Kettlestrings

(57) ABSTRACT

A newspaper inserting machine for inserting supplements or inserts into signatures or newspaper jackets improves upon conventional inserting machines by modifying the conventional inserting machines existing belt gripping mechanisms for gripping the inserts and for propelling the inserts into the newspaper jackets as the jackets are moved by a conveyor past insert-containing containers. The existing belt gripping mechanisms are modified to be adjustably positionable to accommodate inserts of different thicknesses and are also modified to be adjustably positionable in directions parallel with the conveyor to accommodate inserts of different sizes while reducing the machine set-up time required by operators for different sizes of inserts. The adjustability of the belt gripping mechanisms also increase the capacity of conventional machines for the number of different inserts which can be placed into the newspaper jackets along a conveyor of predetermined length.

15 Claims, 7 Drawing Sheets

APPARATUS FOR PLACING INSERTS OF DIFFERENT THICKNESSES AND WIDTHS INTO NEWSPAPER JACKETS

This application claims the benefit of Provisional application No. 60/196,892, filed Apr. 13, 2000.

BACKGROUND OF THE INVENTION

This invention relates to improved apparatus for placing inserts into newspaper jackets and more particularly to such apparatus which provides for increased capacity for the number of different inserts which can be placed into newspaper jackets as the jackets move along a conveyor of predetermined length and which reduces the set-up time required by operators in preparing the machine for operation.

Inserting machines for placing inserts or supplements into signatures or newspaper jackets are well known. Examples of such machines are described in U.S. Pat. Nos. 2,577,261; 4,085,927 and 4,401,299, each of which patents is incorporated herein by reference.

Each of the machines described in the above-identified patents and other similar machines uses a gripper finger located in a center drum or wheel. The gripper finger is closed onto a pre-printed insert or supplement, and the insert or supplement is carried around the drum by approximately 180°. The insert or supplement is then grasped between two opposing belts, which are commonly referred to as drum belts and tension belts. The gripper finger then opens to release the insert or supplement to be propelled by the belts into an opened newspaper jacket or signature. The gripper finger is operated by a rotating cam which is attached to a shaft upon which a plurality of additional drums or wheels are attached. The drum belts are positioned on one or more of the additional drums or wheels and the tension belts are located in opposition to the drum belts.

Although such devices have served the purpose, they have not proved entirely satisfactory for a number of reasons. For example, only one gripper finger can be used for each stack of inserts because of the physical constraints of the inserter mechanism. As a result, all pre-print inserts must be placed in the exact center of the insert container or pocket to enable the gripper finger to pull the insert around the drum. Elaborate planetary gear timing mechanisms must be employed to allow the operator of the inserter machine to time the rotation of the gripper finger drum to match the exact sequence of the newspaper jacket's cover passing in front of the insert container.

Today, many different sizes of pre-prints or inserts are used. Each different size insert requires that the timing mechanism for the pocket or container for each different sized insert be readjusted by an operator to properly time the propelling of the insert into the jacket as the jacket moves past the insert container.

Pre-print inserts also vary greatly in thickness from a single sheet page to magazines or coupon books of twenty or more pages. The insert gripper finger of existing inserter machines has a manually operated mechanical adjustment to allow for various thicknesses of inserts but requires great skill and a significant amount of time to adjust the gripper finger to properly grasp inserts of different thicknesses.

The average set-up time by a skilled operator for conventional inserting machines having an insert gripping finger is ten to fifteen minutes, depending on the insert sizes and thicknesses.

Also, when using conventional inserter machines having gripper fingers, inserts of only a single size can be placed into each pocket or insert container. Because the inserts must be centered within the pocket or container to enable the inserts to be grasped by the centrally located gripper finger, a significant amount of container or pocket space may be wasted. Thus, if an operator has ten inserts to be placed into one newspaper jacket, the operator requires a conventional inserting machine with eleven pockets, one pocket for the jacket cover and one pocket or container for each insert.

Because the use of an insert gripper finger and all its associated complex timing mechanisms are eliminated in the improved apparatus of this invention, the inserts need not be centered in each insert container or pocket. As a result, more than one size insert can be positioned within each insert container or pocket and the drum and tension belts can be moved to properly remove the inserts from the containers and to propel the inserts into the jackets as the jackets pass by the containers on the conventional jacket conveyor.

It is, therefore, an object of the present invention to provide an improved apparatus for efficiently placing inserts of various sizes and thicknesses into newspaper jackets.

Another object is to provide an improved apparatus for efficiently propelling newspaper jackets or signatures from a container onto a conveyor.

Another object is to provide such apparatus which modifies belt mechanisms currently used in prior art inserting machines for grasping and propelling inserts of different sizes and thicknesses into newspaper jackets.

A further object of the invention is the provision of such apparatus which modifies existing inserter machines to movably adjust the belt gripping mechanisms or assemblies to increase the number of inserts which can be accommodated by the existing inserting machine.

Still another object is to provide such improved apparatus which reduces the set-up time required by operators.

Yet another object of the present invention is the provision of such apparatus which efficiently accommodates inserts of different sizes and thicknesses.

A still further object is to provide such apparatus which eliminates the need for complex planetary gear timing mechanisms and which eliminates the need for a gripper finger mechanism to grasp and remove inserts from each insert stack.

Another object is to provide such apparatus which can insert an increased number of inserts into newspaper jackets at less cost and by using less floor space.

Still another object is to provide such apparatus which uses existing cams and timing mechanisms of conventional inserting machines to activate belt-gripping mechanisms which grasp and propel inserts into newspaper jackets as the jackets are moved by a conveyor along a path past containers holding the inserts.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides apparatus for sequentially feeding stacked inserts one at a time from each of a plurality of insert containers into opened newspaper jackets as the jackets are moved by a conveyor along a path past the containers, the apparatus including a plurality of inserting devices mounted on first supports and controlled by a driver and first timing elements for withdrawing the inserts one at a time from each of the containers and for propelling the inserts into the open jackets as the jackets pass by the containers, wherein the improvement comprises: each of the inserting devices including a first shaft rotatably mounted in the supports and connected in operative relationship for being rotated by the driver; a plurality of first circular drum elements fixedly mounted on the shaft; a plurality of first movable belt assemblies positioned, respectively, on predetermined of the drum elements and between the predetermined drum elements and the conveyor for movement with the predetermined drum elements as the predetermined drum elements are rotated by the shaft; and a plurality of second movable belt assemblies connected in operative relationship with the timing elements and movably adjustable for respective positioning in opposed relationship with the first belt assemblies and the predetermined drum elements for receiving an insert, withdrawn from one of the containers, between the first and second belt assemblies and for propelling the insert into the jacket.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
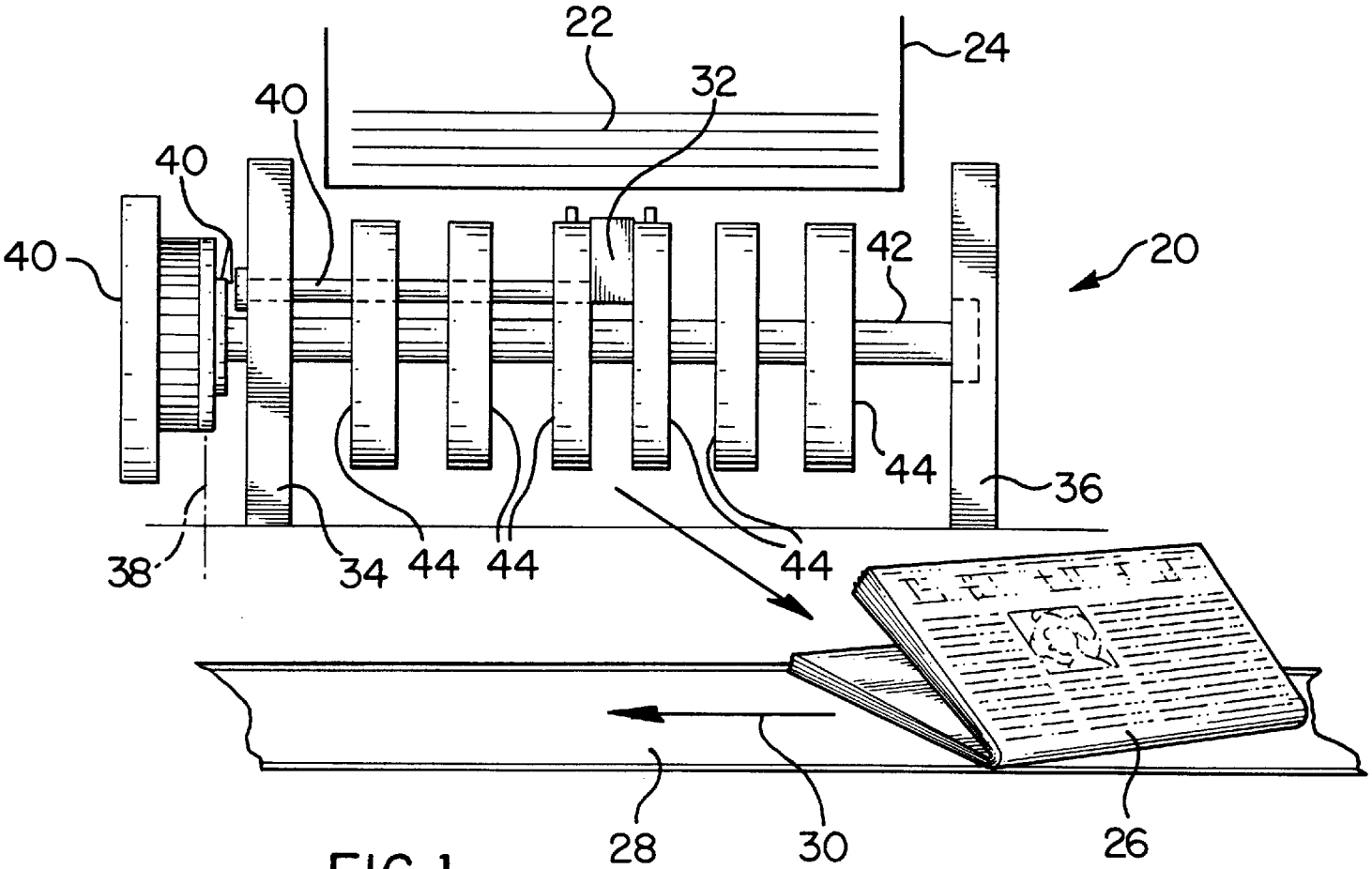
FIG. 1 (PRIOR ART)
FIG. 1 is a diagrammatic view illustrating a prior art inserting machine.
Figure 2:
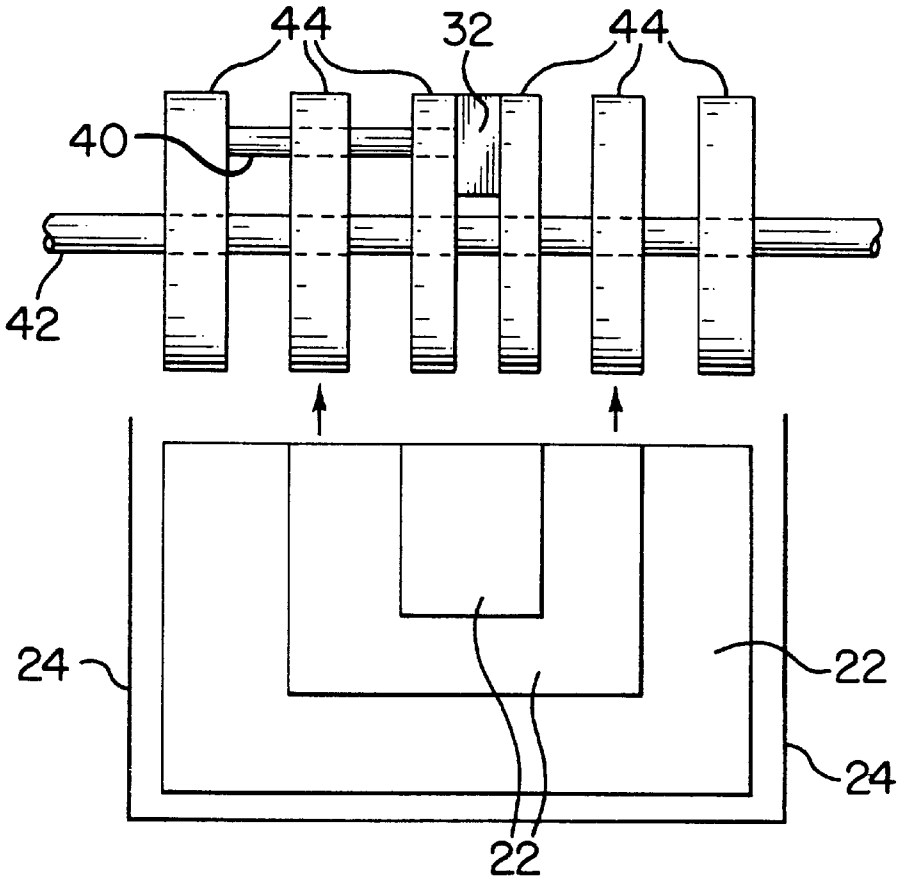
FIG. 2 (PRIOR ART)
FIG. 2 is another diagrammatic view showing the prior art machine of FIG. 1.

With reference now to the drawings, wherein like reference characters designate like or corresponding parts throughout the several views, there is shown in FIGS. 1 and 2 a diagrammatic illustration of prior art apparatus 20 for sequentially feeding stacked inserts 22 one at a time from each of a plurality of insert containers 24 into opened newspaper jackets 26 as the jackets are moved by a conveyor 28 along a path 30 past containers 24. Prior art apparatus 20 typically includes a plurality of inserting devices or gripper fingers 32 positioned, respectively, to withdraw inserts 22 from each of a plurality of containers 24. A plurality of drum elements 44 are mounted on shaft 42, which is mounted on first supports 34, 36. Shaft 42 is driven and controlled by a driver 38. First timing elements 40 are connected to gripper fingers 32 for withdrawing inserts 22 one at a time from each of containers 24 and for propelling inserts 22 into open jackets 26 as the jackets pass by containers 24.

Figure 3:
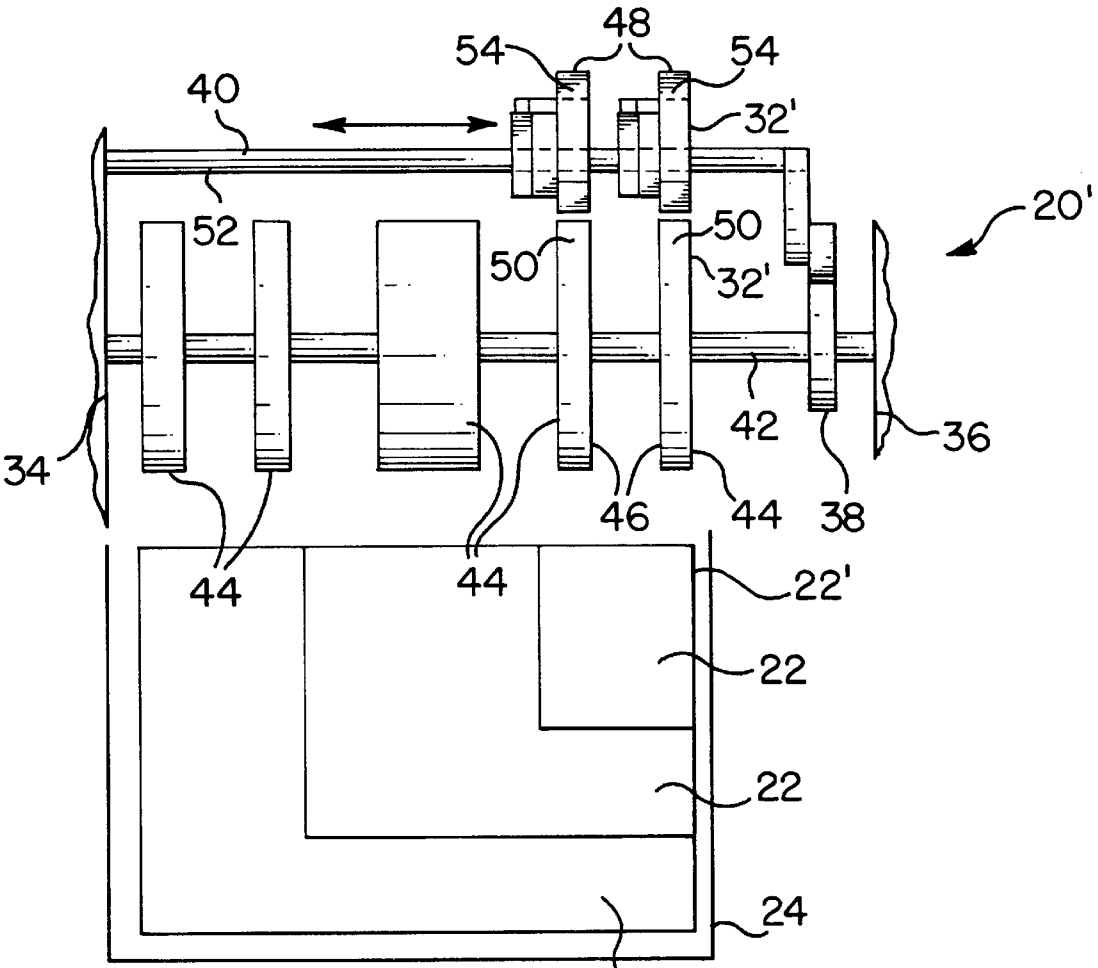
FIG. 3 is a diagrammatic view of inserting apparatus in accordance with this invention.

The improved apparatus 20' of this invention, shown diagrammatically in FIG. 3, provides for each of improved inserting devices 32' to include a first shaft 42 rotatably mounted in supports 34, 36 and connected in a conventional manner for being rotated by driver 38.

In accordance with the invention, improved apparatus 20' further includes a plurality of first circular drum elements 44 fixedly mounted on shaft 42. Apparatus 20' further includes a plurality of first movable belt assemblies 46 positioned, respectively, on predetermined of drum elements 44 and between predetermined drum elements 44 and conveyor 28 for rotational movement with predetermined drum elements 44 as the drum elements are rotated by shaft 42.

Improved apparatus 20' further includes a plurality of second movable belt assemblies 48 connected in a conventional manner to timing elements 40 and movably adjustable for respective positioning in opposed relationship with first belt assemblies 46 and with predetermined drum elements 44 for receiving an insert 22, withdrawn from a container 24, between belt assemblies 46, 48 and for propelling insert 22 into jacket 26.

Figure 4:
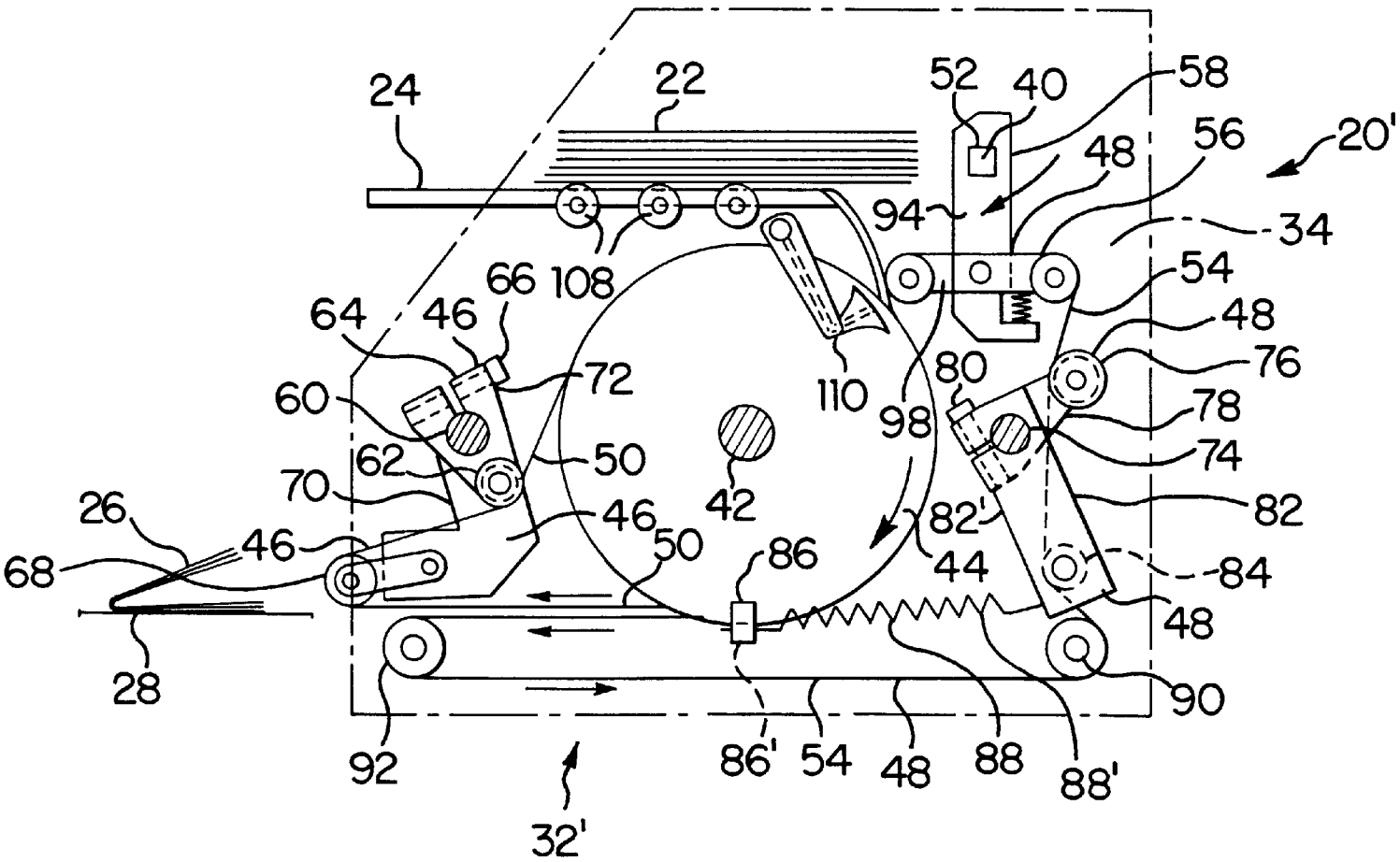
FIG. 4 is a side elevation view illustrating this invention as an insert is being removed from an insert container.
Figure 5:
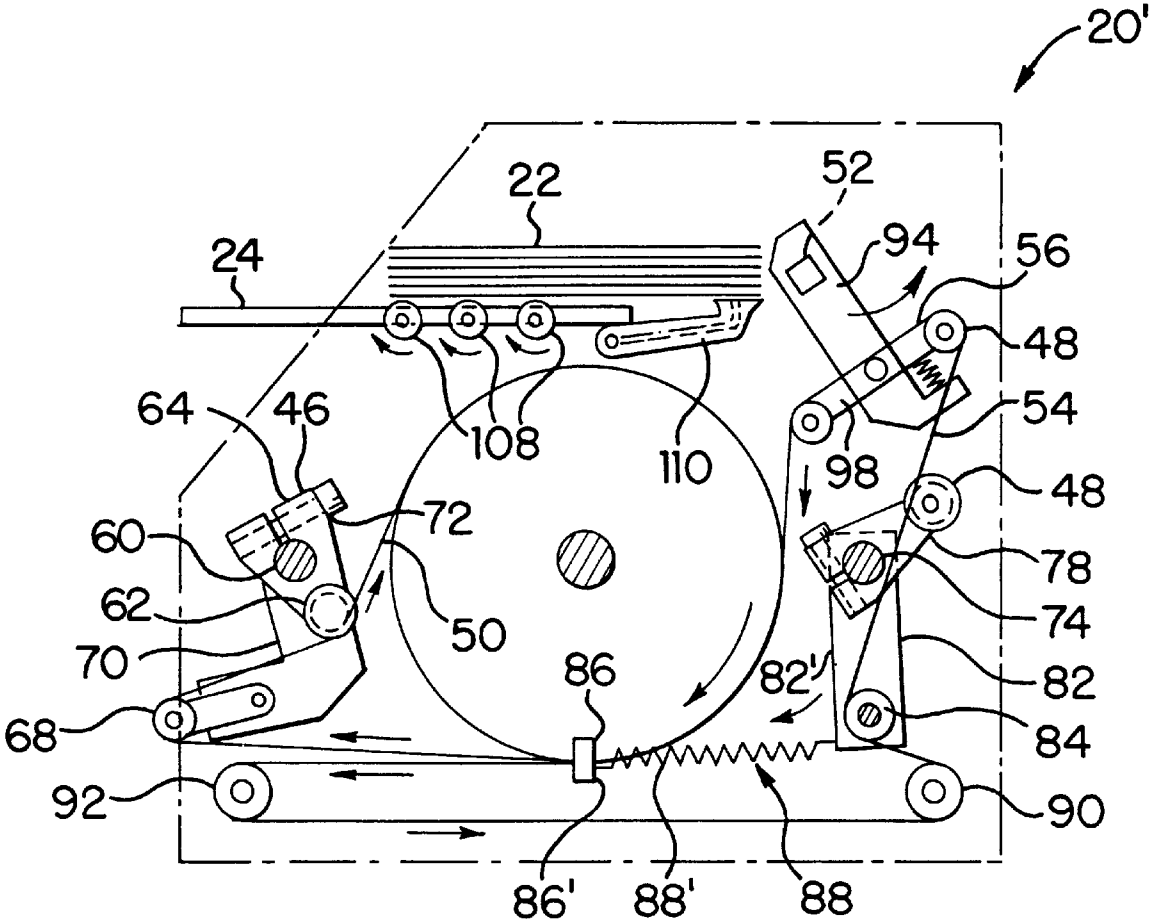
FIG. 5 is a side elevation view showing this invention as an insert is about to be removed from an insert container.
Figure 6:
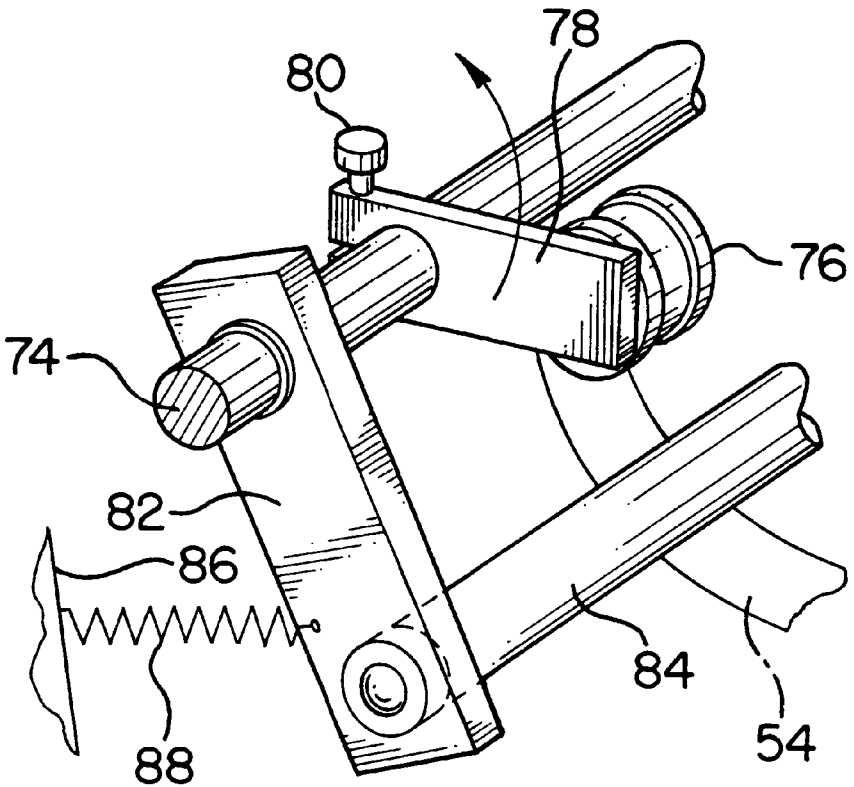
FIG. 6 is a fragmentary perspective view, partly in section, showing a detailed portion of the invention.

Each of first belt assemblies 46, as best seen in FIGS. 4 and 5, includes a first belt 50, and each of assemblies 46 is movably adjustable with respect to drum elements 44 for removably positioning belt 50 of each assembly 46 on a selected one of drum elements 44.

Each of first and second belt assemblies 46, 48 is movably adjustable in directions parallel with respect to shaft 42. Conventional timing elements 40 include a bar 52 conventionally positioned in parallel relationship with shaft 42, and second belt assemblies 48 are each slidably mounted for adjustable positioning along bar 52.

Each of second belt assemblies 48 includes a second belt 54, and each of belt assemblies 48 includes means 56 in operative relationship with belt 54 for adjusting the position of belt 54 with respect to an opposed one of first belts 50 for accommodating inserts 22 of different thicknesses passing between belts 50 and 54.

Each of second belt assemblies 48 further includes means 58 in operative relationship with bar 52 for enabling second belt assembly 48 to be movably adjusted along bar 52 and to be selectively fixedly connected to bar 52.

In accordance with the invention, each of first belt assemblies 46 includes a first rod 60 extending between and supported by supports 34, 36. Rod 60 is positioned in parallel relationship with respect to shaft 42. A first pulley 62 receives first belt 50 thereon, and pulley 62 is rotatably connected to first pulley mount 64, which is slidably and rotatably mounted on first rod 60 to be movably adjusted along and around rod 60.

Each of first movable belt assemblies 46 further includes first means 66, such as a bolt, in operative relationship with first pulley mount 64 for releasably connecting mount 64 in selected fixed positions on rod 60.

Each of first movable belt assemblies 46 further includes a second pulley 68 receiving first belt 50 thereon. A second pulley mount 70 is rotatably connected to second pulley 68 and is slidably and rotatably mounted on first rod 60 to be movably adjusted along and around rod 60. Second means 72, such as a bolt, is provided in operative relationship with second pulley mount 70 for releasably connecting pulley mount 70 in selected fixed positions on first rod 60. Bolt 72 is positioned behind bolt 66 in FIGS. 4 and 5 so that only edge portions of bolt 72 are visible in FIGS. 4 and 5.

Each of second movable belt assemblies 48 further includes a second rod 74 supported by supports 34, 36 and positioned in parallel relationship with respect to shaft 42. A third pulley 76 receives second belt 54 thereon, and a third pulley mount 78 is rotatably connected to pulley 76 and is slidably and rotatably mounted on rod 74 to be movably adjusted along and around rod 74. Third means 80, such as a bolt, is provided in operative relationship with third pulley mount 78 for releasably connecting pulley mount 78 in selected fixed positions on rod 74.

Each of second movable belt assemblies 48 further includes first and second arm members 82, 82', each conventionally rotatably mounted on second rod 74. A third rod 84 is conventionally rotatably mounted on and extends between arm members 82, 82'.

Each of second movable belt assemblies 48 further includes stationary elements or spring mounts 86, 86' connected to supports 34, 36, respectively, and springs 88, 88' are connected to and extend, respectively, between stationary elements 86, 86' and first arm members 82, 82'. Arm member 82', mount 86' and spring 88' are behind arm member 82, mount 86 and spring 88, respectively, as viewed in FIGS. 4 and 5 so that only edge portions 82', 86' and 88' are seen in FIGS. 4 and 5. Third rod 84 receives second belt 54 thereon so that springs 88, 88' act to maintain tension on belt 54. Third rod 84 is in parallel relationship with respect to shaft 42. Each of second movable belt assemblies 48 further includes fourth and fifth rods 90, 92 rotatably supported by supports 34, 36, and each of rods 90, 92 receives second belt 54 thereon.

In accordance with the invention, each enabling means 58 includes a support element 94 slidably mounted on conventional cam bar 52 for adjustable positioning along the bar. Means 96, such as an adjustable screw element, are provided in operative relationship with bar 52 and with support element 94 for releasably and selectively fixedly connecting support element 94 to bar 52.

Adjusting means 56 each includes a pivot arm 98 rotatably mounted to support element 94, and fourth and fifth pulleys 100, 102 are rotatably attached at opposite ends of pivot arm 98 and receive second belt 54 thereon. A second spring 104 is conventionally connected between pivot arm 98 and support element 94 for enabling inserts 22 of various thicknesses to be received between and gripped by belts 50, 54.

Figure 7:
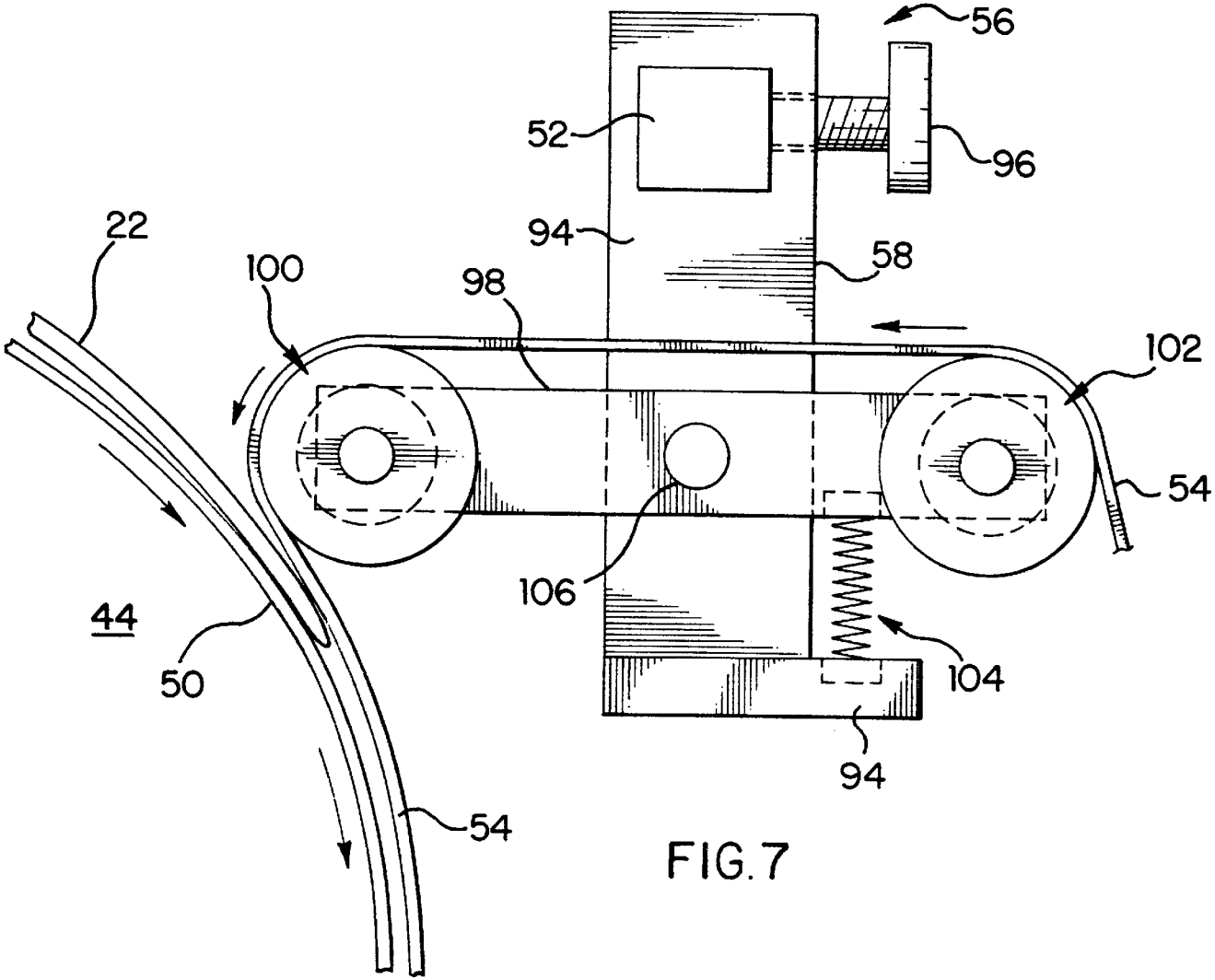
FIG. 7 is a fragmentary side elevation view, partly in section, of a portion of the invention which accommodates inserts of different thicknesses.

Adjusting means 56 each further includes a pivot connector 106 rotatably connecting pivot arm 98 to support element 94, and pivot connector 106 is located between second spring 104 and fourth pulley 100 so that spring 104 acts to urge pulley 100 toward an insert 22 located between belts 50 and 54. See FIG. 7.

Each of insert containers 24 preferably includes a plurality of roller elements 108 for receiving and supporting stacked inserts 22 on roller elements 108 and for facilitating the withdrawal of stacked inserts 22 one at a time from container 24.

The apparatus of this invention is also used for sequentially feeding newspaper jackets 26 one at a time from a stack of jackets in a jacket container onto conveyor 28. The jacket feeding apparatus of this invention is identical to that previously described and illustrated with respect to the sequential feeding of inserts 22. The newspaper jackets 26 propelled onto conveyor 28 by the apparatus of this invention will be moved by the conveyor along a path 30 past insert containers 24, and jackets 26 will be opened in a conventional manner (not shown) for receiving inserts 22 which are propelled into jackets 26 by apparatus 20' of this invention.

FIGS. 1 and 2 show, in diagrammatic form, prior art inserting apparatus 20 which uses a gripper finger 32 for grasping inserts 22 and for moving the inserts around drums 44 to be propelled into jackets 26 by drum and tension belts (not shown in FIGS. 1 and 2). As shown in FIG. 2, all inserts, no matter what size, must be placed in the exact center of container or pocket 24 so that gripper finger 32 can pull the inserts around drum 44. Elaborate planetary gear timing mechanisms 40 must be used in conventional apparatus 20 to properly time the rotation of drum 44 with movement of conveyor 28 to match the exact sequence of the passing of jacket 26 in front of gripper finger 32 and gripping finger drum 44. The timing mechanisms controlling operation of gripper finger 32 must be readjusted for each different size insert, and this timing mechanism readjustment takes a considerable amount of time to accomplish and requires a lengthy set-up time for apparatus 20.

FIG. 3 illustrates, in diagrammatic form, improved apparatus 20' in accordance with this invention. Gripper fingers 32 are eliminated and, instead, existing drum and tension belts 50, 54 and new belt assemblies 46, 48 can be moved or readjusted in position with respect to different drums 44 so that inserts 22, no matter what their size, can be positioned to one side of container or pocket 24. Timing mechanism 40 can now be quickly and easily adjusted so that the propelling of inserts 22 into jackets 26 is properly timed. Edges 22' of inserts 22, no matter what the size of inserts 22, will be automatically aligned with jackets 26 so that inserts 22 will be propelled into jackets 26 in a proper manner as the jackets move past each container station 24 on conveyor 28.

In operation and use of apparatus 20', inserts 22 are stacked within each container 24 with leading edges 22' of the inserts positioned in a predetermined location within container 24. Because of this predetermined alignment of the inserts within container 24, timing mechanism 40, which is conventionally known, needs to be set only one time. Thereafter, inserts 22 of different size can be used within container 24 without the need for resetting the timing mechanism.

During the setting-up process of apparatus 20', belt 50 can be positioned on any desired drum element 44. This can be accomplished by loosening bolts 66, 72 so that pulley mounts 64, 70 and pulleys 62, 68 can be rotated about rod 60 to reduce tension on belt 50. Belt assembly 46, including belt 50, can then be slidably adjusted along rod 60 until belt 50 is properly positioned around a new desired drum element 44. Pulleys 62, 68 and pulley mounts 64, 70 can then be readjusted by rotation around rod 60 so that the proper tension is created on belt 50. Bolts 66, 72 can then be tightened so that belt assembly 46 is held in fixed position with respect to the appropriate drum 44.

Repositioning of second belt assembly 48 so that belt 54 will be located in opposition to belt 50 can also be quickly and easily accomplished. Screw element 96 is loosened by an operator to enable support element 94 to be slidably moved along timing bar 52, which is a conventional element used in prior art apparatus 20. Simultaneously therewith, bolt 80 is loosened to permit pulley mount 78 to be slidably adjusted along rod 74. Belt 54 is slidably moved along and over rods 84, 90 and 92.

When belt assembly 48 has been positioned so that belt 54 is located in opposed relationship with respect to belt 50, screw element 96 can be tightened on to cam bar 52 and bolt 80 can be tightened to fixedly attach pulley mount 78 to rod 74. Springs 88, 88' acting on arm members 82, 82', respectively, will move rod 84 with respect to belt 54 to create proper tension in belt 54.

More than one belt assembly 46 and more than one belt assembly 48 can be used for withdrawing inserts 22 from each pocket or container 24, as shown in FIG. 3.

Inserts 22 are withdrawn from container or pocket 24 in a timed manner so that the inserts are properly propelled into jackets 26 as the jackets move past each station or container 24. Inserts 22 are removed one at a time from the bottom of the stack of inserts by conventional suction element 110. Each insert 22 withdrawn from the insert stack by element 110 is drawn down to a position to be grasped between belts 50, 54 of belt assemblies 46, 48. See FIG. 4. The timing of movement of belt assembly 48 to grasp insert 22 between belts 50 and 54 is controlled by the movement of cam bar 52. The timing of movements of element 110 and of cam bar 52 is conventional and does not form a part of this invention.

FIG. 4 illustrates the position of belt assembly 48 which enables an insert 22, removed by suction element 110 from the insert stack, to be grasped between belts 50, 54. Rotation of shaft 42 by conventional driver 38 causes rotation of drum element 44. As a result, belts 50, 54 which are in contacting relationship with each other are rotated to move insert 22 around drum 44 while being held between belts 50, 54. Insert 22 is then propelled by movement of belts 50, 54 into open jacket 26 as the jacket moves past belts 50, 54 on conveyor 28.

A plurality of pockets or containers 24 containing different inserts 22 are positioned side by side, and each pocket or container 24 is associated with its own belt assemblies 46, 48 as previously described. Thus, a plurality of different inserts can be propelled into jackets 26 as the jackets move on conveyor 28 past the containers 24.

FIG. 5 illustrates the positions of suction element 110 and of belt assembly 48 as an insert 22 is about to be withdrawn from the bottom of the insert stack within a container 24. FIG. 5 illustrates the movement of support element 94 and of adjusting means 56 by movement of cam bar 52.

A similar arrangement to that illustrated in FIGS. 3–7 is used in the improved apparatus 20' of this invention for propelling jackets 26 onto conveyor 28 from a jacket container. The structure and method of operation of apparatus 20' for this purpose is identical to that illustrated in FIGS. 3–7, with the exception that jackets 26 are positioned within a container 24 instead of inserts 22 as illustrated.

Adjusting means 56 of apparatus 20' allows inserts 22 of different thicknesses to be accommodated. Pivot arm 98 mounted on pivot connector 106 is connected to one end of spring 104. The opposite end of spring 104 is connected to support element 94. As an insert 22 is positioned between belts 50 and 54, pivot arm 98 will rotate about pivot connector 106 to accommodate the thickness of insert 22 between belts 50, 54. This rotational movement of pivot arm 98 will compress spring 104, and the action of spring 104 will cause pivot arm 98 to return to its normal position to receive the next insert.

Because inserts 22 do not have to be centered within each pocket or container 24 of apparatus 20', more than one size or type of insert 22 can be stacked within the space occupied by each container 24. As a result, the insert capacity of apparatus 20' is significantly increased with respect to the capacity of conventional insert machines 20. Because gripper finger 32 has been eliminated, the set-up time for apparatus 20' is significantly less than that of prior art apparatus 20. The use of adjusting means 56 in apparatus 20' also enables apparatus 20' to accommodate inserts of widely varying thicknesses.

The invention in its broader aspects is not limited to the specific details shown and described, and departures may be made from such details without departing from the principles of the invention and without sacrificing its chief advantages.

What is claimed is:

1. In apparatus for sequentially feeding stacked inserts one at a time from each of a plurality of insert containers into opened newspaper jackets as the jackets are moved by a conveyor along a path past the containers, the apparatus including a plurality of inserting devices mounted on first supports and controlled by a driver and first timing elements for withdrawing the inserts one at a time from each of the containers and for propelling the inserts into the opened jackets as the jackets pass by the containers, wherein the improvement comprises:

each of said inserting devices including a first shaft rotatably mounted in said supports and connected in operative relationship for being rotated by said driver;

a plurality of first circular drum elements fixedly mounted on said shaft;

a plurality of first movable belt assemblies positioned, respectively, on predetermined of said drum elements and between said predetermined drum elements and said conveyor for movement with said predetermined drum elements as said predetermined drum elements are rotated by said shaft; and a plurality of second movable belt assemblies connected in operative relationship with said timing elements and movably adjustable in directions substantially parallel with respect to said shaft for respective positioning in opposed relationship with said first belt assemblies and said predetermined drum elements for receiving an insert, withdrawn from one said container, between said first and second belt assemblies and for propelling said insert into said jacket.

2. Apparatus as in claim 1 wherein each of said first belt assemblies includes a first belt and is movably adjustable with respect to said drum elements for positioning said first belt on a selected one of said drum elements.

3. Apparatus as in claim 2 wherein said first belt assemblies are movably adjustable in directions substantially parallel with respect to said shaft.

4. Apparatus as in claim 3 wherein said timing elements include a bar positioned in substantially parallel relationship with said shaft and wherein said second belt assemblies are slidably mounted for adjustable positioning along said bar.

5. Apparatus as in claim 4 wherein each of said second belt assemblies includes a second belt and wherein each of said second belt assemblies includes means in operative relationship with said second belt for adjusting the position of said second belt with respect to a said first belt for accommodating inserts of different thicknesses passing between said first and second belts.

6. Apparatus as in claim 5 wherein each of said second belt assemblies includes means in operative relationship with said bar for enabling said second belt assembly to be movably adjusted along said bar and to be selectively fixedly connected to said bar.

7. Apparatus as in claim 6 wherein each of said first movable belt assemblies includes:

a first rod supported by said supports and positioned in substantially parallel relationship with respect to said shaft;

a first pulley receiving said first belt thereon;

a first pulley mount rotatably connected to said first pulley and slidably and rotatably mounted on said first rod to be movably adjusted along and around said first rod; and first means in operative relationship with said first pulley mount for releasably connecting said first pulley mount in selected fixed positions on said first rod.

8. Apparatus as in claim 7 wherein each of said first movable belt assemblies further includes:

a second pulley receiving said first belt thereon;

a second pulley mount rotatably connected to said second pulley and slidably and rotatably mounted on said first rod to be movably adjusted along and around said first rod; and second means in operative relationship with said second pulley mount for releasably connecting said second pulley mount in selected fixed positions on said first rod.

9. Apparatus as in claim 8 wherein each of said second movable belt assemblies further includes:

a second rod supported by said supports and positioned in substantially parallel relationship with respect to said shaft;

a third pulley receiving said second belt thereon;

a third pulley mount rotatably connected to said third pulley and slidably and rotatably mounted on said second rod to be movably adjusted along and around said second rod; and third means in operative relationship with said third pulley mount for releasably connecting said third pulley mount in selected fixed positions on said second rod.

10. Apparatus as in claim 9 wherein each of said second movable belt assemblies further includes:

first and second arm members rotatably mounted on said second rod;

a third rod rotatably mounted on and extending between said first and second arm members;

a first stationary element connected to one of said first supports;

a first spring connected to and extending between said first stationary element and said first arm member; and said third rod receiving said second belt in a predetermined manner thereon, for enabling said first spring to act to maintain tension on said second belt.

11. Apparatus as in claim 10 wherein said third rod is in substantially parallel relationship with respect to said shaft.

12. Apparatus as in claim 11 wherein each of said second movable belt assemblies further includes: fourth and fifth rods rotatably supported by said supports and each of said fourth and fifth rods receiving said second belt thereon.

13. Apparatus as in claim 12 wherein said adjusting means each includes:

a support element slidably mounted on said bar for adjustable positioning along said bar;

means in operative relationship with said bar and said support element for releasably and selectively fixedly connecting said support element to said bar;

a pivot arm rotatably mounted to said support element;

a fourth pulley rotatably attached to said pivot arm and receiving said second belt thereon; and a second spring connected between said pivot arm and said support element for enabling said inserts of various thicknesses to be received between and gripped by said first and second belts.

14. Apparatus as in claim 13 wherein said adjusting means each further includes:

a pivot connector rotatably connecting said pivot arm to said support element, said pivot connector located substantially between said second spring and said fourth pulley, whereby said second spring acts to urge said fourth pulley toward said insert located between said first and second belts.

15. Apparatus as in claim 14 wherein each of said insert containers includes a plurality of roller elements for receiving and supporting said stacked inserts on said roller elements and for facilitating the withdrawal of said stacked inserts one at a time from said container.

* * * * *